US009071900B2

(12) United States Patent
Vesa et al.

(10) Patent No.: US 9,071,900 B2
(45) Date of Patent: Jun. 30, 2015

(54) MULTI-CHANNEL RECORDING

(75) Inventors: Sampo V. Vesa, Helsinki (FI); Jarmo I. Saari, Truku (FI); Miikka Tikander, Helsinki (FI); Timo J. Toivanen, Mantsala (FI)

(73) Assignee: Nokia Technologies Oy, Espoo (FI)

( * ) Notice: Subject to any disclaimer, the term of this patent is extended or adjusted under 35 U.S.C. 154(b) by 298 days.

(21) Appl. No.: 13/589,418

(22) Filed: Aug. 20, 2012

(65) Prior Publication Data

US 2014/0050326 A1 Feb. 20, 2014

(51) Int. Cl.
*H04R 5/027* (2006.01)
*H04R 5/04* (2006.01)

(52) U.S. Cl.
CPC . *H04R 5/027* (2013.01); *H04R 5/04* (2013.01)

(58) Field of Classification Search
CPC ..... H04R 5/027; H04R 5/033; H04R 5/04; H04S 3/00; H04S 3/005
USPC ..... 381/26, 309, 310, 71.6, 74, 92, 94.7, 381/119, 104, 107, 109, 23.1, 71.1, 317, 381/372–375; 379/406.01–406.16
See application file for complete search history.

(56) References Cited

U.S. PATENT DOCUMENTS

| | | | | |
|---|---|---|---|---|
| 4,088,849 | A * | 5/1978 | Usami et al. | 379/430 |
| 4,819,270 | A * | 4/1989 | Lombardo | 381/26 |
| 5,140,637 | A | 8/1992 | McCarthy | 381/1 |
| 5,212,764 | A * | 5/1993 | Ariyoshi | 704/233 |
| 6,405,163 | B1 * | 6/2002 | Laroche | 704/205 |
| 6,690,799 | B1 | 2/2004 | Iwase et al. | 381/17 |
| 6,909,787 | B2 | 6/2005 | Chen | 381/17 |
| 7,949,419 | B2 * | 5/2011 | Kong et al. | 700/94 |
| 8,036,389 | B2 | 10/2011 | Cho | 381/17 |
| 8,189,766 | B1 | 5/2012 | Klein | 379/406.07 |
| 2005/0063536 | A1 | 3/2005 | Myllyla et al. | 379/406.08 |
| 2007/0076891 | A1 | 4/2007 | Cho | 381/1 |
| 2010/0074433 | A1 | 3/2010 | Zhang et al. | 379/406.08 |
| 2011/0129097 | A1 | 6/2011 | Andrea | 381/71.6 |
| 2011/0137658 | A1 | 6/2011 | Lee | 704/278 |
| 2012/0008800 | A1 | 1/2012 | Goerke | 381/104 |
| 2014/0029762 | A1 * | 1/2014 | Xie et al. | 381/94.1 |

FOREIGN PATENT DOCUMENTS

WO WO-2012/046256 A2 4/2012

OTHER PUBLICATIONS

Nokia Essence Bluetooth Stereo Headset (BH-610), 2011, 11 pgs.
"Perceptually-Motivated Nonlinear Channel Decorrelation for Stereo Acoustic Echo Cancellation", Jean-Marc Valin, IEEE, 2008, pp. 188-191.

* cited by examiner

*Primary Examiner* — Vivian Chin
*Assistant Examiner* — Jason R Kurr
(74) *Attorney, Agent, or Firm* — Harrington & Smith

(57) ABSTRACT

An apparatus including a microphone array and a removing system. The microphone array includes a binaural microphone system having first and second transducers, and a voice microphone system having at least one third transducer. The removing system is configured to remove, from signals created from the binaural microphone system, components corresponding to sound of a user's voice sensed at the at least one third transducer.

23 Claims, 6 Drawing Sheets

MULTI-CHANNEL RECORDING

BACKGROUND

1. Technical Field

The exemplary and non-limiting embodiments relate generally to binaural recording and, more particularly, to an apparatus and method for removing sound of a user during the recording.

2. Brief Description of Prior Developments

Binaural recording is a method of recording sound that uses two microphones, arranged with the intent to create a 3-D stereo sound sensation for the listener of actually being in the room with the performers or instruments. Once recorded, the binaural effect can be reproduced using headphones or a dipole stereo for example.

SUMMARY

The following summary is merely intended to be exemplary. The summary is not intended to limit the scope of the claims.

In accordance with one aspect, an example apparatus comprises a binaural microphone system comprising a first transducer and a second transducer which are configured to be located proximate left and right ears of a user and located relative to each other for binaural recording; and a voice microphone system comprising at least one third transducer configured to sense speaking activity of the user, where the voice microphone system is located on or around a head of the user for sensing the speaking activity.

In accordance with another aspect, an example apparatus comprises binaural recording inputs configured to receive left and right channel signals from first and second binaural ear transducers; a voice input configured to receive a voice signal from at least one third transducer; and a system for removing from the left and right channel signals, based at least partially upon the voice signal from the at least one third transducer, components corresponding to sound of a user's voice sensed at the at least one third transducer.

In accordance with another aspect, an example apparatus comprises a microphone array comprising a binaural microphone system having first and second transducers, and a voice microphone system having at least one third transducer; and a system for removing from signals created from the binaural microphone system components corresponding to sound of a user's voice sensed at the at least one third transducer.

In accordance with another aspect, an example method comprises converting sound sensed at left and right transducers of a binaural microphone into respective first and second electrical signals; converting sound sensed at one or more third transducers into a third electrical signal; and removing components from the first and second electrical signals which correspond to the sound sensed at the one or more third transducers.

In accordance with another aspect, an example apparatus comprises a non-transitory program storage device readable by a machine, tangibly embodying a program of instructions executable by the machine. The operations comprise removing from a first electrical signal, created from a first transducer of a binaural microphone system, components which correspond to sound sensed at one or more third transducers; and removing from a second electrical signal, created from a second transducer of the binaural microphone system, components which correspond to the sound sensed at the one or more third transducers.

BRIEF DESCRIPTION OF THE DRAWINGS

The foregoing aspects and other features are explained in the following description, taken in connection with the accompanying drawings, wherein.

DETAILED DESCRIPTION OF EMBODIMENTS

Figure 1:
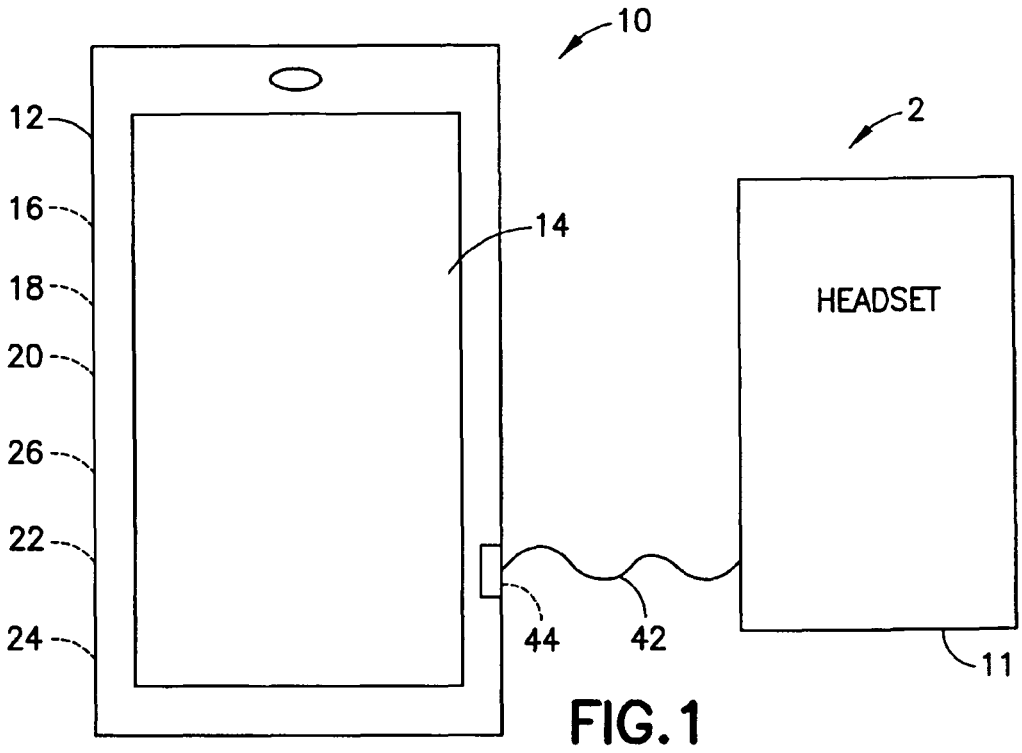
FIG. 1 is a diagram illustrating an example apparatus.

Referring to FIG. 1, there is shown a front view of an apparatus 2 incorporating features of an example embodiment. Although the features will be described with reference to the example embodiments shown in the drawings, it should be understood that features can be embodied in many alternate forms of embodiments. In addition, any suitable size, shape or type of elements or materials could be used.

The apparatus 2 includes a device 10 and a headset 11. The device 10 may be a hand-held communications device which includes a telephone application, such as a smart phone for example. The device 10 may also comprise an Internet browser application, camera application, video recorder application, music player and recorder application, email application, navigation application, gaming application, and/or any other suitable electronic device application. The device 10, in this example embodiment, comprises a housing 12, a display 14, a receiver 16, a transmitter 18, a rechargeable battery 26, and a controller 20 which can include at least one processor 22, at least one memory 24, and software. However, all of these features are not necessary to implement the features described below. In an alternate example, the device 10 may be a computer or a sound system for recording sound for example.

The display 14 in this example may be a touch screen display which functions as both a display screen and as a user input. However, features described herein may be used in a display which does not have a touch, user input feature. The user interface may also include a keypad (not shown). The electronic circuitry inside the housing 12 may comprise a printed wiring board (PWB) having components such as the controller 20 thereon. The circuitry may include a sound transducer provided as a microphone and a sound transducer provided as a speaker and/or earpiece. The receiver 16 and transmitter 18 form a primary communications system to allow the apparatus 10 to communicate with a wireless telephone system, such as a mobile telephone base station for example.

Figure 2:
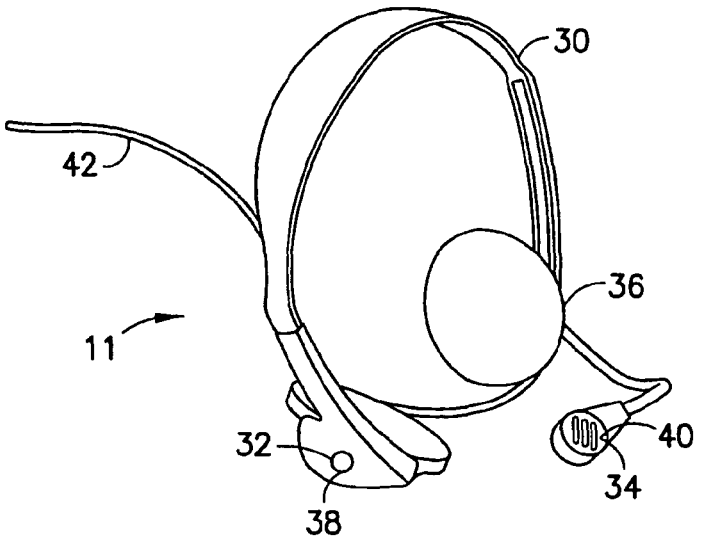
FIG. 2 is a perspective view of an example of a headset of the apparatus shown in FIG. 1.

Referring also to FIG. 2, the headset 11 generally comprises a frame 30, a binaural microphone system 32, and a voice microphone system 34. The frame 30 is sized and shaped to support the headset on a user's head. The binaural microphone system 32 comprises a first microphone 36 which forms a left microphone, and a second microphone 38 which forms a right microphone. The first and second microphones are located relative to each other on the headset frame 30 to be located proximate left and right ears of a user for binaural recording. The voice microphone system 34 comprises a third microphone 40. The third microphone 40 is located on the frame 30 to be positioned at a mouth of the user for recording sound/voice from a user's mouth. Please note that this is merely an example. As another example, an alternative could be an in-ear headset where the third microphone would be located in a wire going to one of the earpieces. The headset 11 is connected to the device 10 by an electrical cord 42. The connection may be a removable connection, such as with a removable plug 44 for example. In an alternate example, a wireless connection between the headset and the device may be provided.

Figure 3:
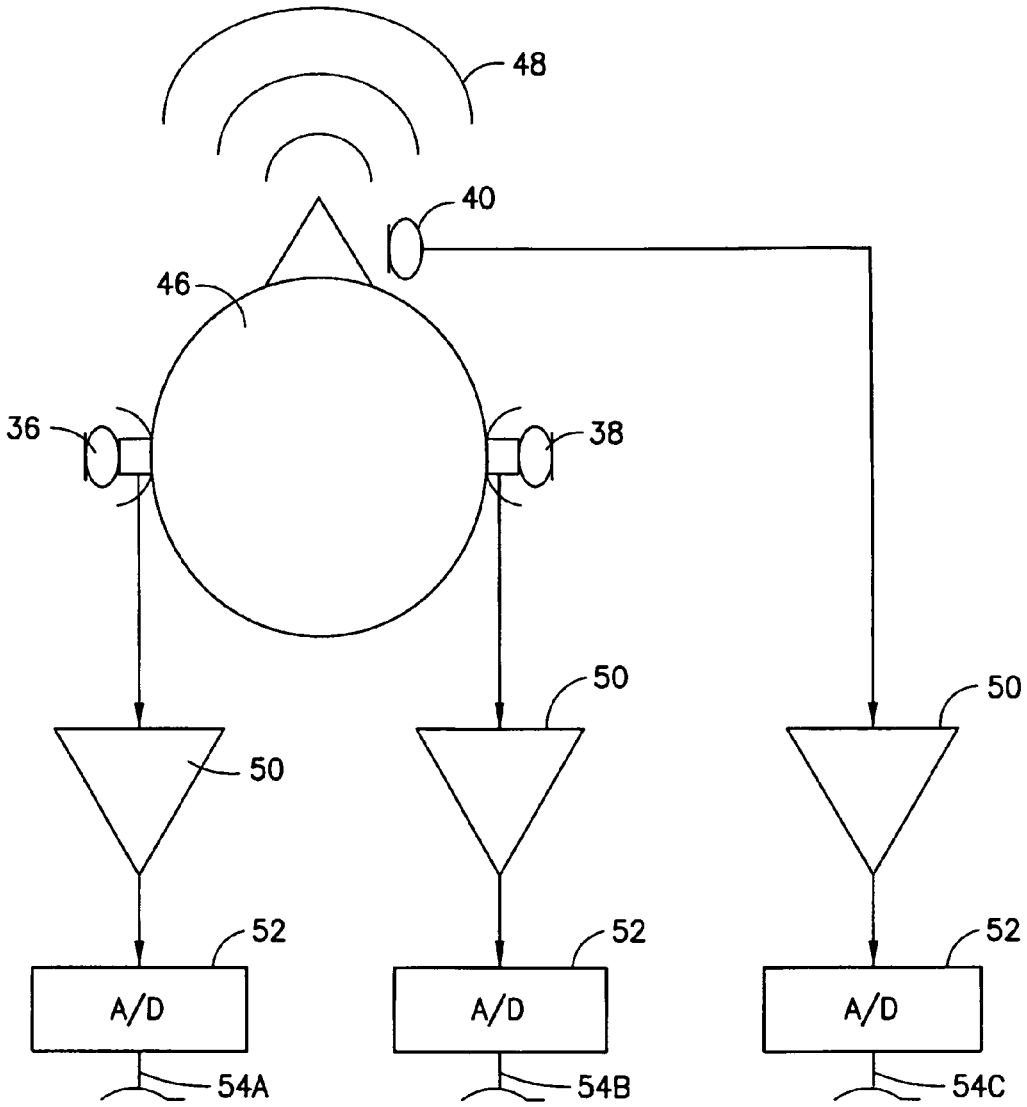
FIG. 3 is a diagram illustrating some of the components of the apparatus shown in FIG. 1.

Referring also to FIG. 3, a schematic illustration of location of the three microphones 36, 38, 40 relative to a user 46 is shown. The first and second microphones 36, 38 are located at the ears of the user 46. Sounds received at the microphones 36, 38 are transformed into electrical signals by the microphones. The third microphone 40 is located proximate the mouth of the user to sense voice or sound 48 from the user's mouth, and transform that sound into a voice electrical signal. In this example the headset 11 comprises an amplifier 50 for each respective microphone 36, 38, 40, and an analog-to-digital (A/D) converter 52 for each respective microphone 36, 38, 40. Thus, three outputs 54A, 54B, 54C are provided; one output from each microphone and its respective amplifier and A/D converter. In an alternate example the amplifiers and analog-to-digital converters may be located in the device 10. The three outputs may be transferred in digital form to the device 10; where the rest of the processing may take place. The transfer may be done, for example, using BLUETOOTH or WiFi. The audio may be compressed with an audio codec, or it may be transferred as uncompressed raw audio.

Figure 4:
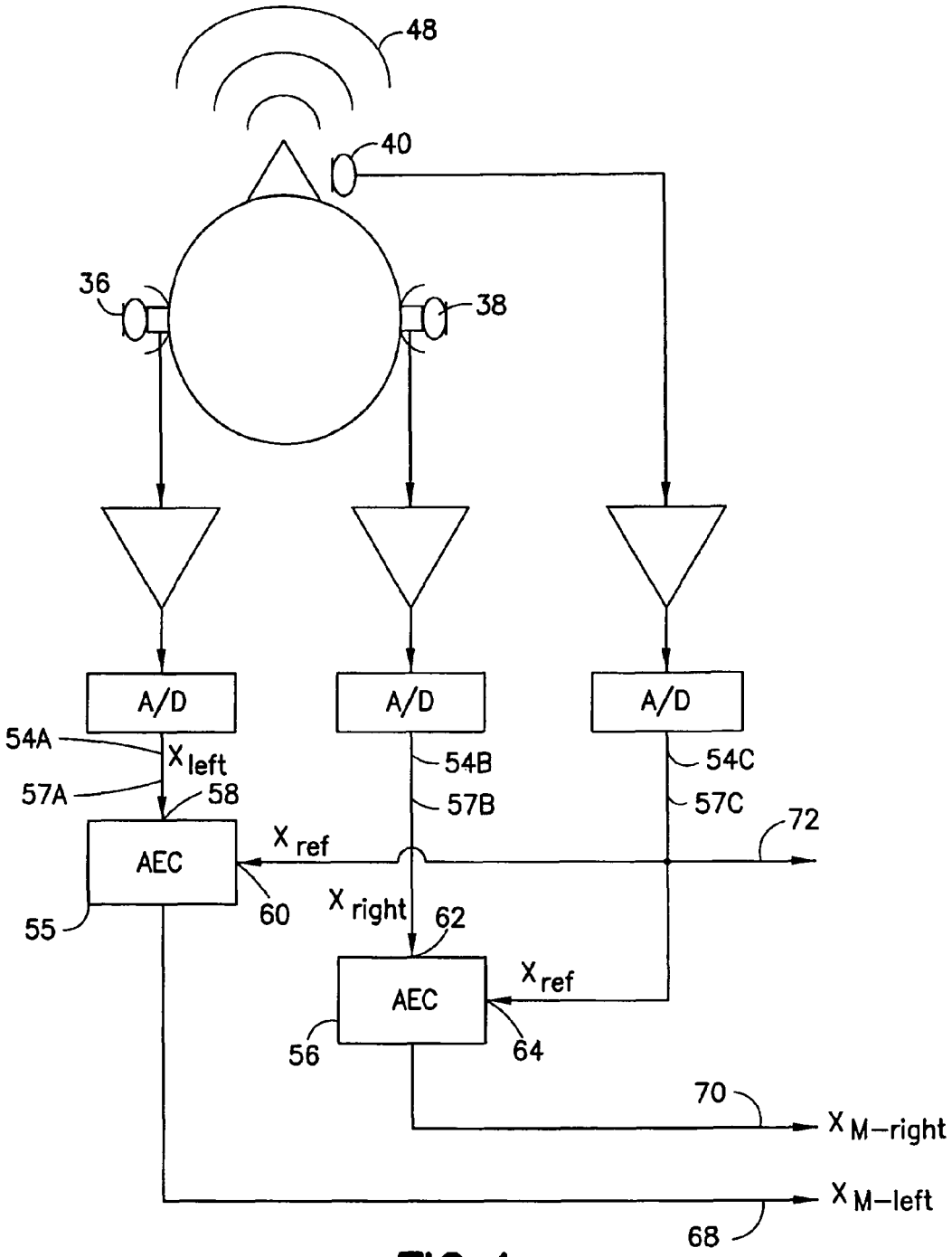
FIG. 4 is a diagram similar to FIG. 3 showing some more of the components of the apparatus shown in FIG. 1.

Referring also to FIG. 4, the headset is shown connected to components in the device 10. However, in an alternate example all the components shown in FIG. 4 might be located in the headset 11. The circuitry in the device 10 includes a system for removing from the left and right microphone signals, based at least partially upon the voice signal from the third microphone 40, components corresponding to sound of the user's voice 48 sensed at the third microphone 40. The removing system comprises an acoustic echo cancellation system configured to remove sound of voice 48 of the user sensed by the voice microphone system from the sound of the voice of the user sensed by the binaural microphone system. In this example the acoustic echo cancellation system comprises a first acoustic echo cancellation control 55 and a second acoustic echo cancellation control 56. The first acoustic echo cancellation control 55 has a first input 58 from the first microphone 36 and a second input 60 from the third microphone 40. The second acoustic echo cancellation control 56 has a first input 62 from the second microphone 38 and a second input 64 from the third microphone 40. Each acoustic echo cancellation control comprises an acoustic echo cancellation algorithm or software run on a processor, such as the processor 22 for example. However, the acoustic echo cancellation controls may be separate from the main processor 22, such as on a dedicated chipset(s) for example.

The output 54A forms the input 58. The output 54B forms the input 62. The output 54C forms the inputs 60, 64. The first acoustic echo cancellation control 55 is configured to use the two inputs 58, 60 and form an output 68. The output 68 is a signal corresponding to the sound sensed at the left microphone 36 with sound corresponding to the user's voice (sensed at the microphone 40) removed. The second acoustic echo cancellation control 56 is configured to use the two inputs 62, 64 and form an output 70. The output 70 is a signal corresponding to the sound sensed at the right microphone 38 with sound corresponding to the user's voice (sensed at the microphone 40) removed.

The left and right ear signals are captured by the binaural microphones, then amplified with a microphone amplifier, and converted to digital domain using the A/D converters ($X_{left}$ and $X_{right}$). Similarly, the voice commentary signal is captured by a third microphone located close enough to the mouth, amplified with a microphone amplifier, and converted to digital domain using an A/D converter ($X_{ref}$). The positioning and/or directivity of the third microphone should be such that the voice of the user dominates in the signal. In other words, the positioning and/or directivity of the third microphone may be such that the voice of the user has a high enough level, compared to other sounds (including background noise), present in the signal captured by the third microphone. After this stage, there can also be storage and/or transmission to another device (if there is e.g. wireless connection between the headset and the phone). Also, if the processing is done in the device 10 rather than in the headset 11, the audio may be streamed in real-time for listening with another device. For example, the audio may be streamed in real-time over the Internet for another user (or group of users) to listen.

The speech 48 of the user is removed using two similar AEC algorithms, one for each channel (the left channel and the right channel). The speech signal from the microphone 40 acts as the reference signal to both of the AECs 55, 56, so the adaptive filter (or similar algorithm) in the AECs will try to estimate how the speech signal shows up in the binaural signals ($X_{left}$ and $X_{right}$). The speech signal ($X_{ref}$) is then subtracted (or otherwise removed) from each of the binaural signals ($X_{left}$ and $X_{right}$) and a binaural signal ($X_{M\text{-}left}$ and $X_{M\text{-}right}$) with the speech of the user removed is obtained as the outputs 68, 70. The speech signal ($X_{ref}$) may also be provided as an output 72.

The algorithm for removing the speech of the user from the binaural signal can be any algorithm which can estimate how the reference (speech) signal shows up in the binaural signal, and then remove it. AEC algorithms (especially those based on adaptive filters, such as a Normalized Least Mean Squares (NLMS) filter) are very well suited for this purpose. In order to get a reference signal which has only speech present, the third microphone 40 can be placed inside the ear canal of the user.

Figure 5:
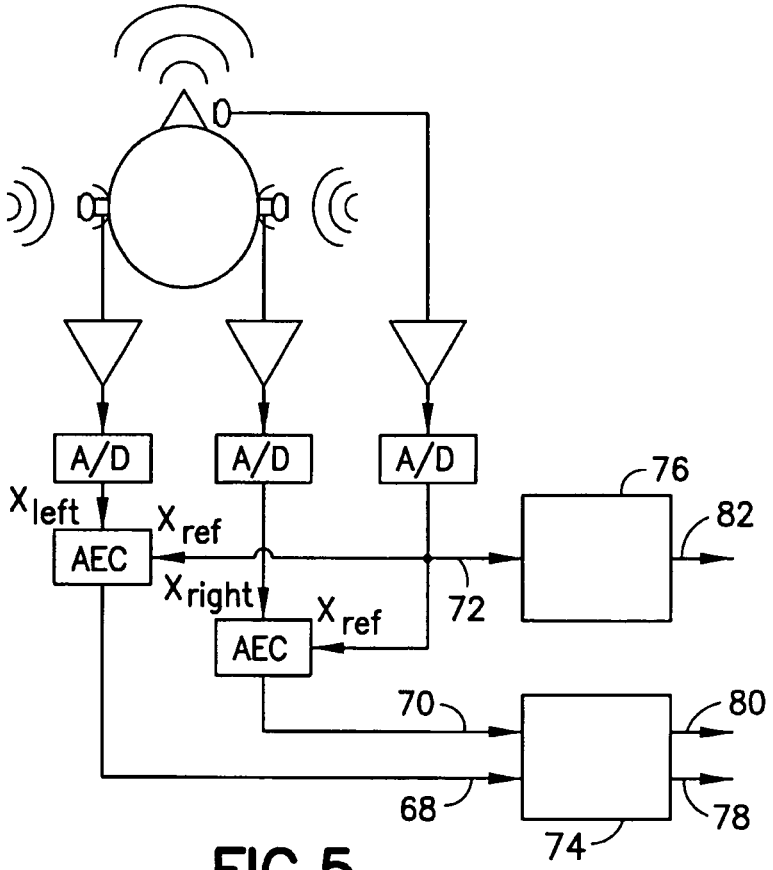
FIG. 5 is a diagram similar to FIG. 4 showing post processing which may be applied to signals of the apparatus.

Referring also to FIG. 5, the two signals (binaural signal from outputs 68, 70 with the speech of the user removed, and the speech signal from output 72) may be subjected to post-processing (such as Automatic Gain Control [AGC], Dynamic range compression [DRC], Equalization [EQ], etc., for example) as indicated by blocks 74, 76. This produces modified signals 78, 80 and 82. This may be provided in the headset 11 or the device 10 or another device. There may also be storage of the signals after the A/D converters and/or before or after the post-processing blocks, such as in the memory 24 for example.

Figure 6:
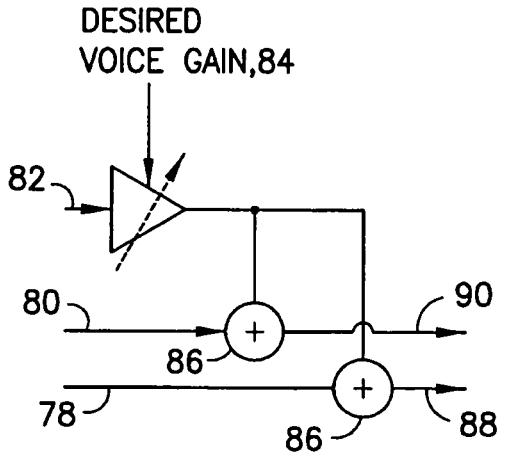
FIG. 6 is a diagram illustrating how a voice signal may be added back into the other signals.

Referring also to FIG. 6, during playback, the speech (commentary) track from signal 82 may be mixed back with adders 86 at a desired volume level by component 84 to the binaural signal from which it was removed. This may produce the left and right channel signals 88, 90. These left and right channel signals may be played back using a headset that a user (not necessarily the same person who made the recording) will wear. There may be at least D/A converters and amplifiers in the signal path. It is possible for the user to experience the video with or without audio the commentary 82. It should be noted that the binaural audio may be played back by other means, such as playback using stereo, 5.1, or 7.1 after proper a upmix/conversion, but of course this would not necessarily have the same acoustics of a binaural playback.

Features as described herein may be used for binaural recording using microphones near the entrances of the ear canals, and removing the voice of the user wearing the microphones based on speech captured by a third microphone close to the mouth of the user. When a user is recording a binaural recording, with microphones mounted (e.g. on a headset), the voice of the user may be captured quite strongly by the microphones. When listening to the recording using headphones, the voice is equally strong in the left and the right channels, so it will be perceived to be located in the middle. The binaural recording can be the soundtrack of a video recorded simultaneously at the phone side. The user who is shooting the video using the mobile device 10 and the audio with the binaural microphones may want to comment on the situation verbally. However, it would be very convenient to be able to control the loudness of this commentary when watching the video later. In some situations it may even be desirable to mute the commentary while preserving all other sounds. Features as described herein present a solution for controlling the level of such a commentary track.

In karaoke applications, algorithms for removing the vocals from a song usually take advantage of the fact that lead vocals are typically amplitude-panned in the middle (equal gain in left and right channels of a stereo mix). However, for a binaural recording this approach of voice removal does not work, as there are reflections present and simple voice signal cancellation methods cannot be used. Also, it is important to preserve the spatial impression in the binaural signal, which is not fulfilled by standard vocal component cancellation techniques. Finally, with vocal component cancellation methods the vocal component cannot be extracted, which may be required in the commentary track use case.

Features as describe herein may be used for removing the voice of the user making a binaural recording, where the binaural recording audio may be recorded usually together with video. This is accomplished by first using an acoustic echo cancellation (AEC) algorithm, which may be based on an adaptive filter, for removing the voice of the user from the binaural signal. The voice captured by a third reference microphone placed close to the mouth (e.g. one of the wires that go to the ear pieces) may be used as a reference. Secondly, this close-miked speech track, which typically consists of user commentary on the situation being recorded, can then be mixed at a desired level to the binaural track, from which the speech of the user was removed using the AEC. In most cases, it is desirable to turn the commentary either ON or OFF while listening and watching the video.

In some embodiments, the user commentary could be placed to a different direction than the middle (same gain in both channels). For example, we could use positional 3D techniques, such as Head-Related Transfer Function (HRTF) filtering, to place the user commentary track to originate at a heading of, for example, 60° to the left.

Prior to the mixing of the commentary with the binaural signal, there may be storage so that the audio tracks are stored in a video file after post-processing. During playback, the commentary may be mixed to the binaural track as desired.

The presented method, especially if an adaptive filter-based AEC is used, may avoid "musical noise" artifacts. "Musical noise" artifacts may result from methods that are based on time-frequency manipulations, such as certain types of source separation and noise reduction methods.

An example apparatus may comprise a binaural microphone system 32 comprising a first microphone 36 and a second microphone 38 which are configured to be located proximate left and right ears of a user and located relative to each other for binaural recording; and a voice microphone system comprising a third microphone 40 which is configured to be located proximate a mouth of the user.

The apparatus may further comprise a connector 44 for connecting an output 54 from each of the first, second and third microphones to another member 10. The apparatus may further comprise a means for wirelessly connecting the output 54 from each of the first, second and third microphones to another member 10. The apparatus may further comprise analog-to-digital converters 52 connected to respective ones of the first, second and third microphones. The apparatus may further comprise amplifiers 50 connected between respective pairs of the microphones and analog-to-digital converters. The apparatus may further comprise means for removing from signals from the first and second microphones, based at least partially upon a voice signal from the third microphone, components corresponding to sound of the user's voice sensed at the third microphone. The apparatus may further comprise an acoustic echo cancellation system configured to remove a sound of a voice of the user sensed by the voice microphone system from the sound of the voice of the user sensed by the binaural microphone system. The acoustic echo cancellation system may comprise a first acoustic echo cancellation control 55 having a first input from the first microphone and a second input from the third microphone, and a second acoustic echo cancellation control 56 having a first input from the second microphone and a second input from the third microphone. The apparatus may further comprise an output 54 comprising three signals including binaural left and right signals comprising signals created based upon sound received by the first and second microphones with sound of the voice of the user removed, and a voice signal created based upon sound received by the from the third microphone. The apparatus may further comprise means 84, 86 for selectively mixing the voice signal into the left and right signals.

An example apparatus may comprise binaural recording inputs 57A, 57B configured to receive left and right microphone signals from binaural ear microphones; a voice input 57C configured to receive a voice signal from a mouth microphone; and a system 55, 56 for removing from the left and right microphone signals, based at least partially upon the voice signal from the mouth microphone, components corresponding to sound of a user's voice sensed at the mouth microphone. The system for removing may comprise an acoustic echo cancellation system. The acoustic echo cancellation system comprises a first acoustic echo cancellation control having a first input from a first one of the binaural recording inputs and a second input from the voice input, and a second acoustic echo cancellation control having a first input from a second one of the binaural recording inputs and a second input from the voice input. The apparatus may comprise three outputs 68, 70, 72 comprising binaural left and right outputs from the first and second acoustic echo cancellation controls, respectively, and a third output comprising the voice input. The apparatus may further comprise a microphone system 36, 38, 40 connected to the binaural recording inputs and the voice input, where the microphone system comprises a binaural microphone system comprising a first microphone and a second microphone which are located relative to each other for binaural recording; and a voice microphone system comprising a third microphone which is configured to be located proximate a mouth of the user.

An example apparatus may comprise a microphone array 36, 38, 40 comprising a binaural microphone system having first and second microphones, and a voice microphone system having a third microphone; and a system 55, 56 for removing from signals created from the binaural microphone system components corresponding to sound of a user's voice sensed at the third microphone. The apparatus may further comprise a system for allowing the components to be subsequently added back into the signals. The system for removing comprises an acoustic echo cancellation system. The acoustic echo cancellation system comprises a first acoustic echo cancellation control 55 having a first input from the first microphone and a second input from the third microphone, and a second acoustic echo cancellation control 56 having a first input from the second microphone and a second input from the third microphone.

Figure 7:
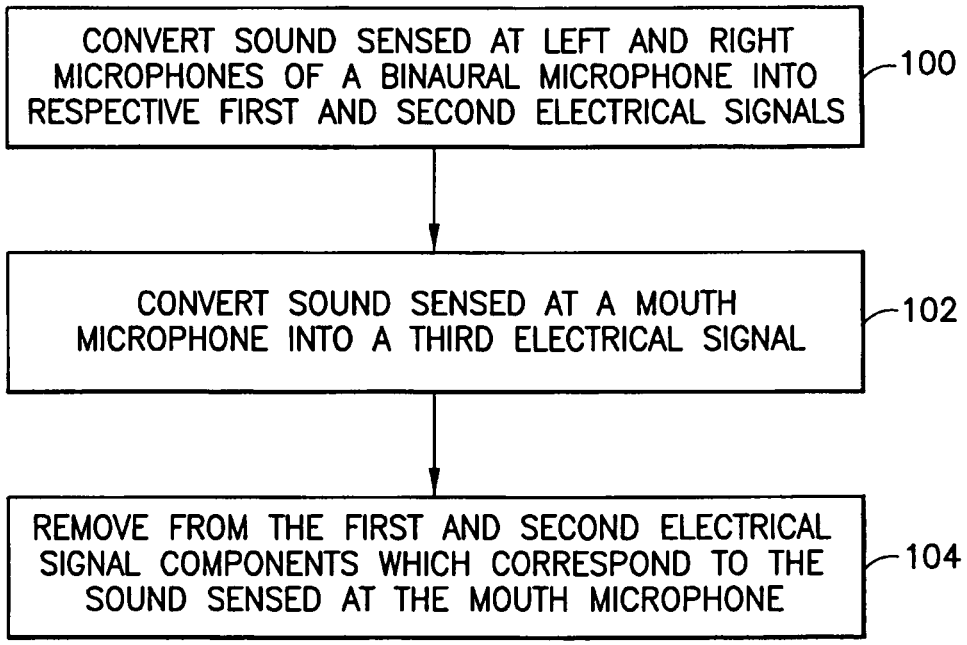
FIG. 7 is a diagram illustrating some steps of an example method.

Referring also to FIG. 7, an example method may comprise converting sound sensed at left and right microphones of a binaural microphone into respective first and second electrical signals as indicated by block 100; converting sound sensed at a mouth microphone into a third electrical signal as indicated by block 102; and removing from the first and second electrical signals components which correspond to the sound sensed at the mouth microphone as indicated by block 104. The method may further comprise subsequently adding the third electrical signal into the first and second electrical signals.

Another example may be provided in a non-transitory program storage device, such as memory 24 or example, readable by a machine, tangibly embodying a program of instructions executable by the machine, the operations comprising removing from a first electrical signal, created from a first microphone of a binaural microphone system, components which correspond to sound sensed at a mouth microphone; and removing from a second electrical signal, created from a second microphone of the binaural microphone system, components which correspond to the sound sensed at the mouth microphone.

In the example shown in the drawings and described above, the voice microphone system 34 comprises the third microphone 40 which is located on the frame 30 to be positioned at the mouth of the user for recording sound/voice from the user's mouth. It should be noted that the voice microphone system may comprise one or more microphones. There may be multi-microphone integrations suitable for voice communications. There are known, for example, implementations where at least two air microphones are used for the uplink audio for directionality and noise cancellation. Features as described herein may be used with such implementations. There are example integrations comprising a two-mic uplink noise canceller, a microphone array for directionality, etc. Thus, in various different example embodiments, the voice microphone system may comprise one microphone or more than one microphone.

It should also be noted that in a different example embodiment the voice microphone system may be assisted by one or more bone conduction transducers. Such transducer(s) may be used on its own or together with an air microphone/transducer in order to detect speech more effectively and to eliminate unwanted noises. It is possible that a binaural headset may comprise one or more in-ear microphones, either in one ear or both ears, wherein the in-ear microphone may face towards the direction where the eardrum is (and inside the ear canal). Such an in-ear microphone(s) may be used for detecting a speech signal when user is speaking. It is understood that such an in-ear microphone does not have to be proximate the mouth of the user. In a similar way, a bone conduction transducer could be suitably positioned on the user's head (such as on the user's neck for example) or around the ear structure for detecting such speech signals.

Figure 8:
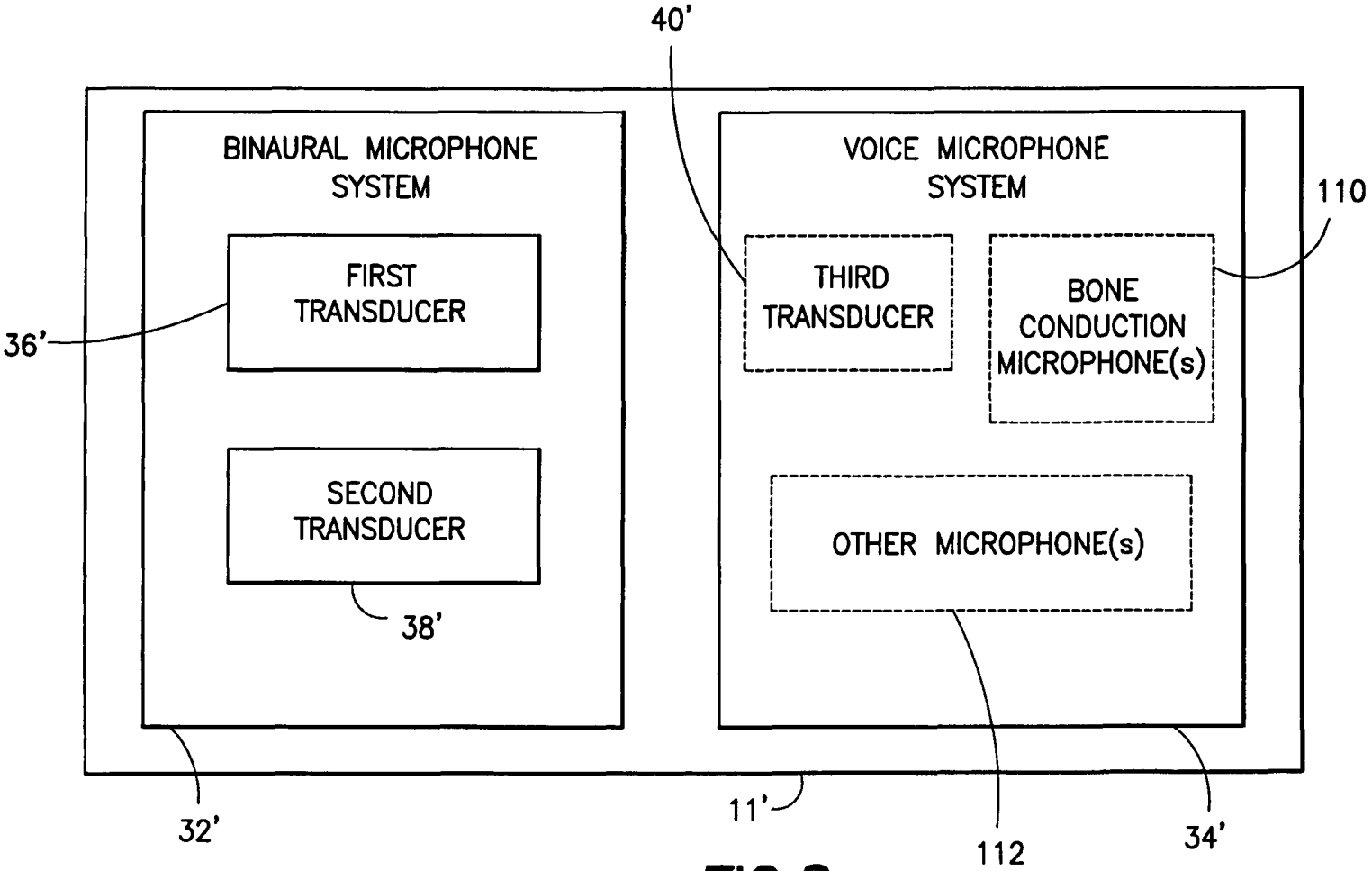
FIG. 8 is a diagram illustrating examples of an apparatus.

Examples of the above are illustrated with reference to FIG. 8 where an apparatus 11' is provided comprising a binaural microphone system 32' and a voice microphone system 34'. The binaural microphone system 32' comprises a first microphone 36' and a second microphone 38'. The voice microphone system 34' may comprise a mouth microphone 40' and/or bone conduction microphone(s) 110 and/or other microphones(s) 112. The entire system may be assisted by a fourth microphone (such as 112) for monitoring the environmental noise. The fourth microphone could be part of the apparatus 11' or could be utilised from an external device. For example the fourth microphone could be the internal microphone of a mobile phone 10.

The bone conduction microphone(s) and/or the in-ear microphone(s) may be used instead of an air microphone for capturing the speech (the reference signal for the AECs). When the air microphone is also used, the bone conduction microphone(s) and/or the in-ear microphone(s) may also assist the procedure by providing a very accurate voice activity data which may be used for controlling the adaptation rate of the AECs. For example, the adaptation could be done only when, or it could be done faster when, the signal captured by the in-ear microphone(s) and/or bone conduction microphone (s) is similar enough to the air microphone. Such as, for example, when there is speech without strong interferers present in the signal captured by the air microphone; as the interferers can otherwise make the AECs diverge, worsening the performance. The voice microphone system may be suitably located proximate a mouth of the user, an ear structure of the user, or any suitable location where a bone conduction and/or an air microphone would detect voice signals.

In accordance with one example embodiment apparatus 2 or 11 or 11' comprises a binaural microphone system 32 comprising a first transducer 36 or 36' and a second transducer 38 or 38' which are configured to be located proximate left and right ears of a user and located relative to each other for binaural recording; and a voice microphone system 34 or 34' comprising at least one third transducer 40 or 110 or 112 configured to sense speaking activity of the user, where the voice microphone system is located on or around a head of the user for sensing the speaking activity.

In accordance with another example embodiment an apparatus 2 or 10 or 11 or 11' comprises binaural recording inputs 57A, 57B configured to receive left and right channel signals from first and second binaural ear transducers; a voice input 57C configured to receive a voice signal from at least one third transducer; and a system 55, 56 for removing from the left and right channel signals, based at least partially upon the voice signal from the at least one third transducer, components corresponding to sound of a user's voice sensed at the at least one third transducer.

In accordance with another example embodiment, an apparatus comprises a microphone array comprising a binaural microphone system having first and second transducers 36, 38 or 36', 38', and a voice microphone system having at least one third transducer 40 or 40' or 110 or 112; and a system 55, 56 for removing from signals created from the binaural microphone system components corresponding to sound of a user's voice sensed at the at least one third transducer.

In accordance with another example, an example method comprises converting 100 sound sensed at left and right transducers of a binaural microphone into respective first and second electrical signals; converting 102 sound sensed at one or more third transducers into a third electrical signal; and removing 104 components from the first and second electrical signals which correspond to the sound sensed at the one or more third transducers.

In accordance with another example embodiment, an apparatus comprises a non-transitory program storage device 24 readable by a machine, tangibly embodying a program of instructions executable by the machine. The operations comprise removing from a first electrical signal, created from a first transducer of a binaural microphone system, components which correspond to sound sensed at one or more third transducers; and removing from a second electrical signal, created from a second transducer of the binaural microphone system, components which correspond to the sound sensed at the one or more third transducers.

It should be understood that the foregoing description is only illustrative. Various alternatives and modifications can be devised by those skilled in the art. For example, features recited in the various dependent claims could be combined with each other in any suitable combination(s). In addition, features from different embodiments described above could be selectively combined into a new embodiment. Accordingly, the description is intended to embrace all such alternatives, modifications and variances which fall within the scope of the appended claims.

What is claimed is:

1. An apparatus comprising:

a binaural microphone system comprising a first transducer and a second transducer which are configured to be located proximate left and right ears of a user and located relative to each other for binaural recording; and a voice microphone system comprising at least one third transducer configured to sense speaking activity of the user, where the voice microphone system is located on or around a head of the user for sensing the speaking activity; and where the apparatus is configured, based at least partially upon a voice signal from the at least one third transducer, to remove components corresponding to sound of the speaking activity of the user from signals from the first and second transducers.

2. An apparatus as in claim 1 further comprising a connector for connecting an output from each of the first, second and third transducers to another member.

3. An apparatus as in claim 1 further comprising analog-to-digital converters connected to respective ones of the first, second and third transducers.

4. An apparatus as in claim 3 further comprising amplifiers connected between respective pairs of the transducers and analog-to-digital converters.

5. An apparatus as in claim 1 further where the apparatus comprises an acoustic echo cancellation system configured to remove the components corresponding to sound of the speaking activity of the user sensed by the voice microphone system from the sound of the speaking activity of the user sensed by the binaural microphone system.

6. An apparatus as in claim 5 where the acoustic echo cancellation system comprises a first acoustic echo cancellation control having a first input from the first transducer and a second input from the at least one third transducer, and a second acoustic echo cancellation control having a first input from the second transducer and a second input from the at least one third transducer.

7. An apparatus as in claim 5 further comprising an output comprising a three signal output for binaural left and right signals comprising signals created based upon sound received by the first and second transducers with sound of the speaking activity of the user removed, and a voice signal output for signals created based upon sound received by the at least one third transducer.

8. An apparatus as in claim 7 further comprising means for selectively mixing the voice signal into the left and right signals.

9. An apparatus as in claim 1 where the at least one third transducer comprises an air microphone which is configured to be located proximate a mouth of the user.

10. An apparatus as in claim 9 where the first and second transducers comprise first and second air microphones located proximate the left and right ears of the user.

11. An apparatus as in claim 1 where the at least one third transducer comprises at least:

a bone conduction transducer, or an air microphone and a bone conduction transducer.

12. An apparatus comprising:

binaural recording inputs configured to receive left and right channel signals from first and second binaural ear transducers located proximate left and right ears of a user;

a voice input configured to receive a voice signal from at least one third transducer located on or around a head of the user; and a system for removing from the left and right channel signals, based at least partially upon the voice signal from the at least one third transducer, components corresponding to sound of a user's voice sensed at the at least one third transducer.

13. An apparatus as in claim 12 where the system for removing comprises an acoustic echo cancellation system.

14. An apparatus as in claim 13 where the acoustic echo cancellation system comprises a first acoustic echo cancellation control having a first input from a first one of the binaural recording inputs and a second input from the voice input, and a second acoustic echo cancellation control having a first input from a second one of the binaural recording inputs and a second input from the voice input.

15. An apparatus as in claim 14 where the apparatus comprises three outputs comprising binaural left and right outputs from the first and second acoustic echo cancellation controls, respectively, and a third output comprising the voice input.

16. An apparatus as in claim 12 further comprising a microphone system connected to the binaural recording inputs and the voice input, where the microphone system comprises:

a binaural microphone system comprising a first microphone as the first binaural ear transducer and a second microphone as the second binaural ear transducer which are located relative to each other for binaural recording; and a voice microphone system comprising a third microphone as the at least one third transducer which is configured to be located proximate a mouth of the user to sense speaking activity of the user.

17. An apparatus comprising:

a microphone array comprising a binaural microphone system having first and second transducers configured to be located proximate left and right ears of a user, and a voice microphone system having at least one third transducer configured to be located on or around a head of the user for sensing the user's voice;

and a system for removing from signals created from the binaural microphone system voice components corresponding to sound of the user's voice sensed at the at least one third transducer.

18. An apparatus as in claim 17 further comprising a system for allowing the voice components to be subsequently added back into the signals.

19. An apparatus as in claim 17 where the system for removing comprises an acoustic echo cancellation system.

20. An apparatus as in claim 17 where the acoustic echo cancellation system comprises a first acoustic echo cancellation control having a first input from the first transducer and a second input from the at least one third transducer, and a second acoustic echo cancellation control having a first input from the second transducer and a second input from the at least one third transducer.

21. A method comprising:

converting sound sensed at left and right transducers located proximate left and right ears of a user of a binaural microphone into respective first and second electrical signals;

converting sound of the user's voice sensed at one or more third transducers located on or around a head of the user into a third electrical signal; and removing components from the first and second electrical signals which correspond to the sound of the user's voice sensed at the one or more third transducers.

22. A method as in claim 21 further comprising subsequently adding the third electrical signal into the first and second electrical signals.

23. A non-transitory program storage device readable by a machine, tangibly embodying a program of instructions executable by the machine, the operations comprising:

removing from a first electrical signal, created from a first transducer located proximate a left ear of a user of a binaural microphone system, voice components which correspond to sound sensed at one or more third transducers located on or around a head of the user; and removing from a second electrical signal, created from a second transducer located proximate a right ear of a the user of the binaural microphone system, the voice components which correspond to the sound sensed at the one or more third transducers.

* * * * *